United States Patent [19]

Hayes et al.

[11] 4,117,292

[45] Sep. 26, 1978

[54] DUAL SPRING ACTUATOR FOR KEYBOARD SWITCH ASSEMBLY

[75] Inventors: James Christopher Hayes; William James Tobin, both of Irvine, Calif.

[73] Assignee: Telaris Telecommunications, Inc., Irvine, Calif.

[21] Appl. No.: 805,347

[22] Filed: Jun. 10, 1977

[51] Int. Cl.[2] ..... H01H 3/12; H01H 13/70

[52] U.S. Cl. ..... 200/340; 200/5 A; 200/159 B; 200/330

[58] Field of Search ..... 200/1 R, 5 R, 5 A, 159 R, 200/159 A, 159 B, 153 V, 295, 329, 330, 338, 340

[56] References Cited

U.S. PATENT DOCUMENTS

| | | | |
|---|---|---|---|
| 3,582,594 | 1/1971 | Twyford | 200/340 |
| 3,773,997 | 11/1973 | Evans et al. | 200/330 X |
| 3,773,998 | 11/1973 | Seeger, Jr. et al. | 200/330 X |
| 3,777,082 | 12/1973 | Hatley et al. | 200/5 A |
| 3,777,090 | 12/1973 | Muller | 200/330 X |
| 3,856,998 | 12/1974 | Sims, Jr. | 200/340 X |
| 3,860,771 | 1/1975 | Lynn et al. | 200/1 R X |
| 3,993,884 | 11/1976 | Kondur et al. | 200/338 X |

FOREIGN PATENT DOCUMENTS

| | | | |
|---|---|---|---|
| 2,335,907 | 1/1975 | Fed. Rep. of Germany | 200/159 B |

*Primary Examiner*—James R. Scott
*Attorney, Agent, or Firm*—Fraser and Bogucki

[57] ABSTRACT

An economical yet versatile dual spring actuator switch assembly providing an excellent tactile impression includes a planar switch closure assembly having domed protrusions extending from a surface thereof to provide switch closure when depressed and a switch actuator assembly. The easily assembled switch actuator assembly includes a cover plate with a guiding, key receiving plate aperture disposed therein opposite each protrusion, a plurality of keys, each key having a central key aperture, and a guide post within the central key aperture and being slideably received by a different plate aperture, a plurality of followers, each disposed adjacent a different protrusion and having a central aperture slideably receiving a guide post in guiding, mating relationship, a plurality of first springs, each maintaining a repulsive force between a different key and the surface, and a plurality of second springs, each coupling a different key to a follower to communicate a switch closure force to a protrusion upon depression of a key. The double spring arrangement permits independent selection of key and protrusion actuation forces and buffers each protrusion from its associated key for longer switch lifetime.

12 Claims, 2 Drawing Figures

DUAL SPRING ACTUATOR FOR KEYBOARD SWITCH ASSEMBLY

BACKGROUND OF THE INVENTION

1. Field of the Invention

This invention relates to key switch assemblies of the type used for calculators and telephones and more particularly to such assemblies having a dual spring actuation mechanism.

2. Discussion of the Prior Art

A keyboard frequently represents a major portion of the cost of a product such as a calculator or a pushbutton telephone. It thus becomes extremely important to minimize keyboard costs while maintaining a satisfactory tactile impression for the keyboard operator. Great effort has thus been made to develop less expensive batch fabricated keyboards with better tactile feel and longer lifetime. While significant improvements have resulted from this development effort, further improvement is needed because of the large production volumes of keyboard assemblies and because of the significant cost contributions which they make to many products.

One arrangement of a batch fabricated switch assembly is illustrated in U.S. Pat. No. 3,383,487 to Weiner. Weiner teaches the use of opposed, mating oppositely directed protrusions with switch closure contacts on the inside thereof. While this arrangement meets the requirements of an inexpensive, batch fabricated switch assembly, it does not provide the elegance of an actuator key nor permit selection of desired tactile impression for an operator.

Another keyboard arrangement in which actuator keys drive individual diaphragms is taught by Boulanger in U.S. Pat. No. 3,783,205. This arrangement has individual actuator keys but does not have the advantages of a low cost batch fabricated switch assembly nor a dual spring actuator as taught by the present invention.

Double spring key actuators are described in U.S. Pat. No. 3,993,884 to Kondur et al, U.S. Pat. No. 3,780,237 to Seeger, Jr. et al, and U.S. Pat. No. 3,856,998 to Sims, Jr. These patents teach arrangements which are relatively complex and expensive and do not teach the advantages of combining a dome shaped switch closure assembly with a dual spring actuator assembly.

SUMMARY OF THE INVENTION

An easily assembled dual spring actuator switch assembly in accordance with the invention includes a domed protrusion type of switch closure assembly and an actuator assembly having a first spring biasing a key to a nonactuated position and a second spring extending between the key and a follower which exerts switch closure force against the domed protrusion. The second spring buffers the protrusion from ever making direct contact with the key and permits the protrusion compression force to be determined independent of the key return force. A smaller dome depression force combined with the isolation of the dome from direct key pressure greatly increases the life of the switch assembly.

When the second spring has a zero force length less than or equal to the distance between the key and a protrusion engaging follower when the switch is nonactuated, the key may have a substantial travel before switch closure to minimize unwanted closures. At the same time the combined snap action characteristic of the domed protrusion and the independent spring constant and length of the second spring afford an excellent low bounce electrical characteristic. The protrusion provides a closure force-distance hysteresis characteristic in which a key must be returned a considerable distance after closure to open a switch. The problem of switch "tease" or rapid bouncing at the point of switch closure is thus eliminated. The effects of independently determining the key return force, allowing the key travel distance to exceed the small domed protrusion closure distance, and the slight sensory feedback provided as the protrusion snaps through center combine to provide an operator with an excellent tactile perception.

BRIEF DESCRIPTION OF THE DRAWING

A better understanding of the invention may be had from a consideration of the following detailed description taken in conjunction with the accompanying drawings, in which.

DETAILED DESCRIPTION

Figure 1:
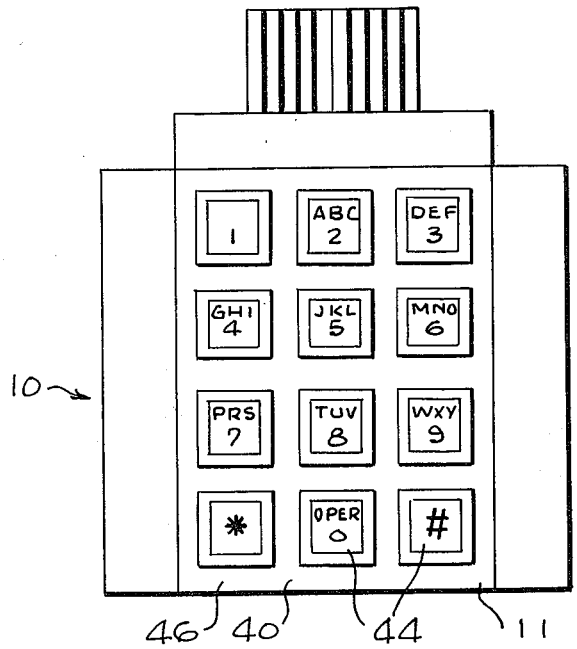
FIG. 1 is a top view of a keyboard switch assembly in accordance with the invention.
Figure 2:
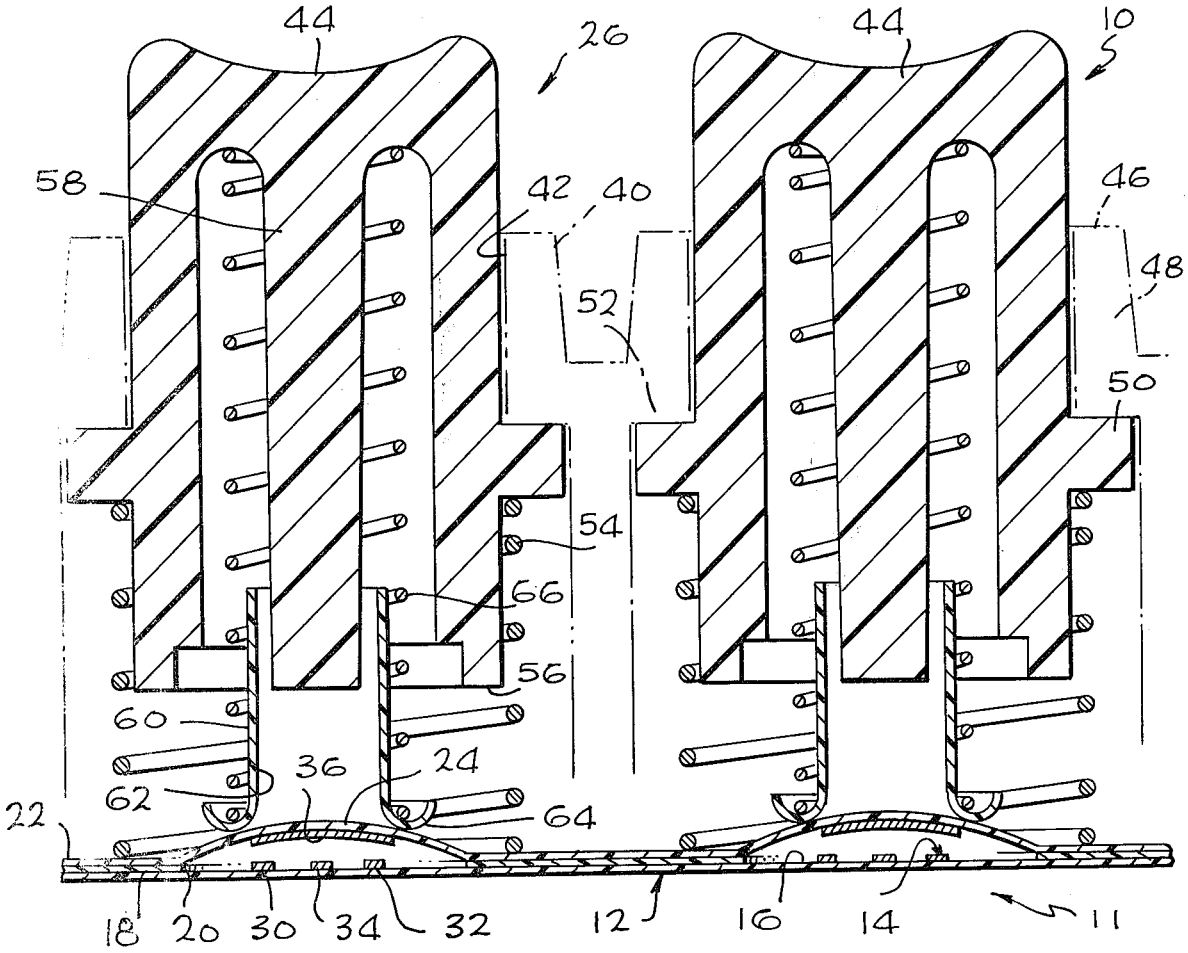
FIG. 2 is a detailed sectional view of the switch assembly showing a key actuator in accordance with the invention.

As shown in FIGS. 1 and 2, a dual spring keyboard switch assembly 10, in accordance with the invention includes a switch contact assembly 11 having a substrate 12 having a circuit pattern 14 defining switch contacts printed in switch regions of a surface 16 thereof, a dielectric polyester film spacer 18 having apertures 20 in the switch regions disposed adjacent the surface 16, a planar dielectric layer 22 with dome-shaped protrusions 24 disposed adjacent the spacer 18 on a side thereof opposite the surface 16 with the domed protrusions 24 in opposed relationship to the switch regions. It should be appreciated that the thickness of the various planar elements of the switch contact assembly 11 have been shown somewhat exaggerated for convenience of illustration. For example, the substrate 12 may be mylar or other polyester film with a thickness of 1 to 12 mils or other suitable material with a printed circuit pattern 14 defined thereon. The printed circuit pattern in this particular arrangement includes a column conductor 30, a row conductor 32 and a common conductor 34 with switch closure provided by a dome conductor 36 extending across the column conductor 30, the row conductor 32 and the common conductor 34 providing electrical connection between all three conductors to indicate a row and column at which a key actuation occurs. The spacer 18 may be a thin sheet of polyester film or other suitable dielectric material having a thickness at least several mils greater than the height of the printed conductor pattern 14 above the surface 16 of substrate 12, to maintain the dome conductor 36 out of electrical contact with the printed circuit pattern 14 in the absence of a switch closure actuation force which depresses a dome-shaped protrusion 24 downward in a snap through center action to engage the conductive pattern 14.

The actuator assembly 26 includes a cover plate 40 which extends across the keyboard with a plurality of key receiving apertures 42 which receive the actuation keys, position them above the domed protrusions 24 at key switch regions of the assembly and guide uniaxial motion of the keys 44. The cover plate 40 has a top surface 46 and sidewalls 48 at each switch position which form the key 44 receiving apertures and extend from the top surface 46 to the layer 22 where they may be secured to maintain the top surface 46 in spaced relationship to the switch contact assembly 11. Each of the keys 44 has a flange 50 which extends radially outward to engage a radially inward extending flange 52 of the cover plate 40 to provide a first limit on axial motion of the keys 44 in a direction perpendicular to the surface 16. At the first limit of key motion, the key 44 is a nonactuated or zero travel distance position and an associated switch is open. A first helical coil compression spring 54 extends between the flange 50 of each key and the top surface of layer 22 to maintain each key 44 in a normally nonactuated position. The spring constant of spring 54, the length of spring 54 and the travel distance between the first limit position and a second limit position at which a bottom edge 56 of a key 44 engages the layer 22 may be independent of switch closure considerations determined to provide an operator with a desired tactile perception.

Each key 44 has a central aperture which extends axially part way therethrough from the end adjacent the layer 22 and a guidepost 58 extending therein. A follower 60 has a central aperture 62 therein extending perpendicular to the surface 16 which receives guidepost 58 in guiding mating and sliding relationship to maintain the follower 60 in position above the domed protrusion 24 as an actuator key 44 slides between the first and second limit positions within the key receiving aperture 42. The follower 60 curves radially outward at the bottom to define a flange 64 which engages a second helical coil compression spring 66, which extends concentrically about the follower 60 and guidepost 58 and within the first spring 54 between the flange 64 and an uppermost portion of the key aperture.

The length and spring constant of the second spring 66 may be chosen independent of the characteristics of first spring 54 to provide a desired switch closure characteristic. However, it is preferred that the second spring 66 be slightly shorter than the distance between the flange 64 and the upwardmost point of a key aperture which receives second spring 66 to permit some travel of a key 44 before second spring 66 exerts a relative force between follower 60 and the key 44. The spring constant of the second spring 66 should be sufficient to assure inversion of a domed protrusion 24 when the key 44 is still a short distance from the second limit position to assure switch closure notwithstanding tolerances and spring characteristics. As the domed protrusion 24 snaps through center in response to a switch actuation force caused by depression of a key 44, the force required to maintain a protrusion 24 in a closed or inverted position is less than that required to cause it to snap through center. Thus, as soon as a domed protrusion 24 snaps through center to provide switch closure, the switch actuation force exerted by follower 60 is more than that required to maintain switch closure and a switch remains closed until the key is returned at least a short distance toward the first limit, which defines a nonactuated condition. This assures that as a key is slowly depressed, a tease or rapid bounce condition does not occur in which the domed protrusion 24 is in an unstable closure condition in which a rapid succession of switch openings and closures occurs.

The switch contact assembly 11 is readily fabricated in an inexpensive yet highly reliable batch fabrication process while the switch actuator assembly 26 may be rapidly and economically assembled by first inserting the keys 44 into the key receiving apertures 42 of cover plate 40, by then inserting the second spring 66 followed by the followers 60 and finally the first spring 54 with the switch contact assembly 11 then being secured to the actuator assembly 26 to maintain the entire keyboard switch assembly in permanently fixed relationship. The cover plate 40, actuator keys 44, and followers 60 are readily provided as inexpensive molded plastic components and the first and second springs 54, 56 are inexpensive items which complete a keyboard switch assembly which is readily assembled from inexpensive components. Notwithstanding the inexpensive and simple construction of the switch assembly 10, it is highly reliable and provides an operator with an excellent tactile perception.

While a particular arrangement of a keyboard switch assembly in accordance with the invention has been shown and described for the purpose of enabling a person of ordinary skill in the art to make and use the invention, it will be appreciated that the invention is not limited thereto. Accordingly, any modifications, variations or equivalent arrangements within the scope of the attached claims should be considered to be within the scope of the invention. What is claimed is:

1. A keyswitch assembly comprising:

a substrate having disposed on a surface thereof an electrical circuit defining at least one first switch contact at each of a plurality of switch regions;

a switch carrier assembly including a plurality of second switch contacts, at least one being disposed at each switch region for switch closure engagement with a first switch contact in response to a switch actuation force; and a switch actuator assembly disposed to selectively provide a switch actuation force at each switch region, the actuator assembly including for each switch region a follower disposed to engage the switch carrier assembly and transmit a switch actuation force to a second switch contact, the follower having a central aperture for slideably receiving a guide post; a key having central aperture with a guide extending therein, the key slideably receiving the follower within the aperture thereof with the guide post being received within the central aperture of the follower; a guideway being disposed to receive the key at a position proximate the switch region and to limit key motion between fixed limit points along a single axial direction; a first spring disposed in compression between the substrate and the key and tending to maintain the key at a first axial limit position spaced farthest from the substrate; a second spring disposed between the follower and the key to apply a minimum force therebetween when the key is at the first axial limit position and a maximum force therebetween when the key is at a second axial limit position spaced nearer the substrate, said second spring force providing the sole coupling force between the key and the follower, the coupling force being sufficient to cause switch closure when the key is at the second limit position and insufficient to cause switch closure when the key is at the first limit position.

2. The switch assembly according to claim 1 above, wherein the second spring is a helical coil type compressible spring disposed concentrically about the follower and the post.

3. The switch assembly according to claim 1 above, wherein the second spring exerts zero force between the key and follower when the key is at the first limit.

4. The switch assembly according to claim 3 above, wherein the second spring exerts no force between the key and follower until the key has moved axially partway from the first limit toward the second limit.

5. The switch assembly according to claim 1 above, wherein the post constrains motion of the follower to axial motion along the post.

6. The switch assembly according to claim 5 above, wherein the first spring is a helical coil spring disposed concentrically about the second spring.

7. A key switch assembly comprising:

a switch contact assembly having a plurality of switch regions disposed along a generally planar surface and a dome-shaped protrusion extending from the surface at each switch region to provide switch closure when the protrusion is forced inward toward the surface in response to a switch actuation force; and a switch actuator assembly disposed to selectively exert a switch actuation force upon each protrusion, the actuator assembly including a cover plate disposed adjacent the surface with a key receiving aperture opposite each protrusion, each key receiving aperture being shaped to receive and guide uniaxial sliding motion of a key therein between first and second greater and lesser spaced limits respectively relative to the surface, a key disposed within each key receiving aperture in guided sliding relationship thereto to move between the first and second limits, the key having a central key aperture therein and a post disposed within the key aperture, a follower disposed adjacent each protrusion with a follower aperture slideably receiving a post in guiding, mating relationship, a first spring disposed to extend between the surface and the key to maintain a relative repulsive force therebetween, and a second spring disposed between the key and the follower and providing a relative repulsive force therebetween which is sufficient to cause switch closure when a key is at the second limit.

8. The switch assembly according to claim 7 above, wherein the follower has a flange extending radially outward therefrom to receive the second spring and wherein the second spring is a helical coil spring extending between the follower flange and an innermost position of the key aperture and is disposed concentrically about the follower and the post.

9. The switch assembly according to claim 8 above, wherein the second spring is not in significant compression and exerts no significant force on the follower when the key is at the first limit.

10. The switch assembly according to claim 9 above, wherein the first spring is disposed concentrically about the second spring.

11. The switch assembly according to claim 10 above, wherein each key has a radially outward extending flange which receives a mating second spring.

12. The switch assembly according to claim 11 above, wherein the cover plate has at each key receiving aperture a radially inward extending cover plate flange spaced apart from the surface, each cover plate flange engaging a key flange of a received key to provide the first limit of slideable motion thereof.

* * * * *

UNITED STATES PATENT AND TRADEMARK OFFICE

CERTIFICATE OF CORRECTION

PATENT NO. : 4,117,292

DATED : September 26, 1978

INVENTOR(S) : James Christopher Hayes and William James Tobin

It is certified that error appears in the above-identified patent and that said Letters Patent are hereby corrected as shown below:

Column 4, line 45, after "guide" and before "extending", insert --post--; line 55, after "substrate;" and before "a", insert --and--.

Signed and Sealed this

*Twenty-sixth* Day of *December 1978*

[SEAL]

*Attest:*

RUTH C. MASON
*Attesting Officer*

DONALD W. BANNER
*Commissioner of Patents and Trademarks*